United States Patent [19]

Broersma

[11] Patent Number: 4,653,123

[45] Date of Patent: Mar. 31, 1987

[54] AERODYNAMIC BICYCLIST'S HELMET CONSTRUCTION

[75] Inventor: Lester V. Broersma, Bellflower, Calif.

[73] Assignee: Bell Helmets Inc., Norwalk, Calif.

[21] Appl. No.: 837,518

[22] Filed: Mar. 7, 1986

[51] Int. Cl.[4] ..... A42C 5/04; A42B 3/00

[52] U.S. Cl. ..... 2/425; 2/171.3

[58] Field of Search ..... 2/6, 10, 417, 421, 424, 2/425, 183, 413, 171.3

[56] References Cited

U.S. PATENT DOCUMENTS

| | | | |
|---|---|---|---|
| 1,234,589 | 7/1917 | Wells | 2/181.6 |
| 1,447,106 | 2/1923 | Turpin | 2/413 |
| 4,075,714 | 2/1978 | Ryder | 2/6 |
| 4,110,847 | 9/1978 | Dera | 2/421 |
| 4,115,874 | 9/1978 | Hasagawa | 2/425 |
| 4,117,553 | 10/1978 | Bay | 2/10 |
| 4,305,160 | 12/1981 | Sundahl | 2/424 |
| 4,434,514 | 3/1984 | Sundahl et al. | 2/421 X |
| 4,464,799 | 8/1984 | Nava | 2/421 |
| 4,519,099 | 5/1985 | Kamiya et al. | 2/424 |

*Primary Examiner*—Louis K. Rimrodt

*Attorney, Agent, or Firm*—William W. Haefliger

[57] ABSTRACT

A bicyclist's helmet has an outer shell; an inner liner; forward air inlet structure and rearward air discharge structure, as well as air channeling in between the inlet and discharge to provide ram effect cooling; resiliently collapsible bellows padding on the liner to engage the wearer's head; retention straps that pass through the liner in order to attach to the outer shell; insert plugs associated with the outer shell to anchor the straps in spaced relation to the channeling and collapsible pads; a wrap-around eye protective visor that also provides a sun shade, the visor being detent adjustable at the front of the helmet; and a retention strap buckle that takes-up excess strap length.

18 Claims, 13 Drawing Figures

AERODYNAMIC BICYCLIST'S HELMET CONSTRUCTION

BACKGROUND OF THE INVENTION

This invention relates generally to helmets, and more particularly concerns a safety helmet of the type worn by bicyclists, and having a construction enhancing comfort and safety of the wearer.

In the past, it was known to provide air vents in helmets, as for example are described in U.S. Pat. No. 3,496,854 to Feldman and U.S. Pat. No. 3,925,821 to Lewicki. Such helmets lack the unusually advantageous features of construction, beneficial results and combinations thereof as are now provided by the present helmet, these including enhanced safety, ram air cooling, adjustability to the wearer's head via bellows type pads; enhanced eye protection via wrap-around adjustment; and retention strap take-up.

SUMMARY OF THE INVENTION

It is a major object of the invention to provide an improved helmet incorporating all of the above referenced advantages and results. Basically, the helmet comprises:

(a) an outer shell containing forwardly facing opening means through which air streams may enter the helmet, (b) a liner in said outer shell and supporting same adjacent said openings, (c) the liner forming air flow channeling communicating with said opening means, the channeling openly facing the interior of the helmet lengthwise of said channeling for conducting air toward the rear of the helmet, (d) and the outer shell containing a rearwardly facing outlet rearward of said channeling for discharging air therefrom.

In this regard, forward facing opening means is at the center front of the helmet, and said rearward outlet is at the center rear of the helmet, the helmet being elongated rearwardly toward said center rear outlet and the forward facing opening means, said channeling and said rearward outlet being in such direct and unobstructed alignment as to provide a ram air flow effect through the helmet.

As will also appear, padding may be carried by the liner, the padding having bellows configuration and being resiliently collapsible upon engagement with a wearer's head; and the padding may with unusual advantage include multiple pads attached to the inner side of said liner, in spaced relation to said channeling, there being collapsible air spaces between successively collapsible portions of said pads, and the liner. Such pads typically are distributed about the inner side of the liner; and they may define successive collapsible sections of successively greater peripheral outline, facing the helmet interior.

It is another object of the invention to provide helmet retention safety straps extending through the liner and attached to the shell, inwardly of the outer side thereof, and in spaced relation to said channeling; and in this regard, the shell may include insert plug means covering offset shell sections to which the straps are attached between the liner and the shell outer surface, the plug means for example including forward and rearward plugs covering two of said sections to each of which two straps are attached.

Additionally, a transparent darkened visor may be closely wrapped about the forward portion of the helmet to conform to the contour thereof, the visor having rearward terminal extents pivotally attached to the helmet, and there being detents at the exterior forward extent of the helmet engageable by the visor in different elevation positions thereof; and the visor may have integral pivot studs projecting from said rearward terminal extents of the visor and received in corresponding pivot openings in the sides of the shell.

Finally, the retention system may include a buckle having multiple slots arranged in ladder form for reception of excess strap extent, and a closure insertible in the buckle to cover the slots.

These and other objects and advantages of the invention, as well as the details of an illustrative embodiment, will be more fully understood from the following specification and drawings, in which:

DRAWING DESCRIPTION

DETAILED DESCRIPTION

Figure 1:
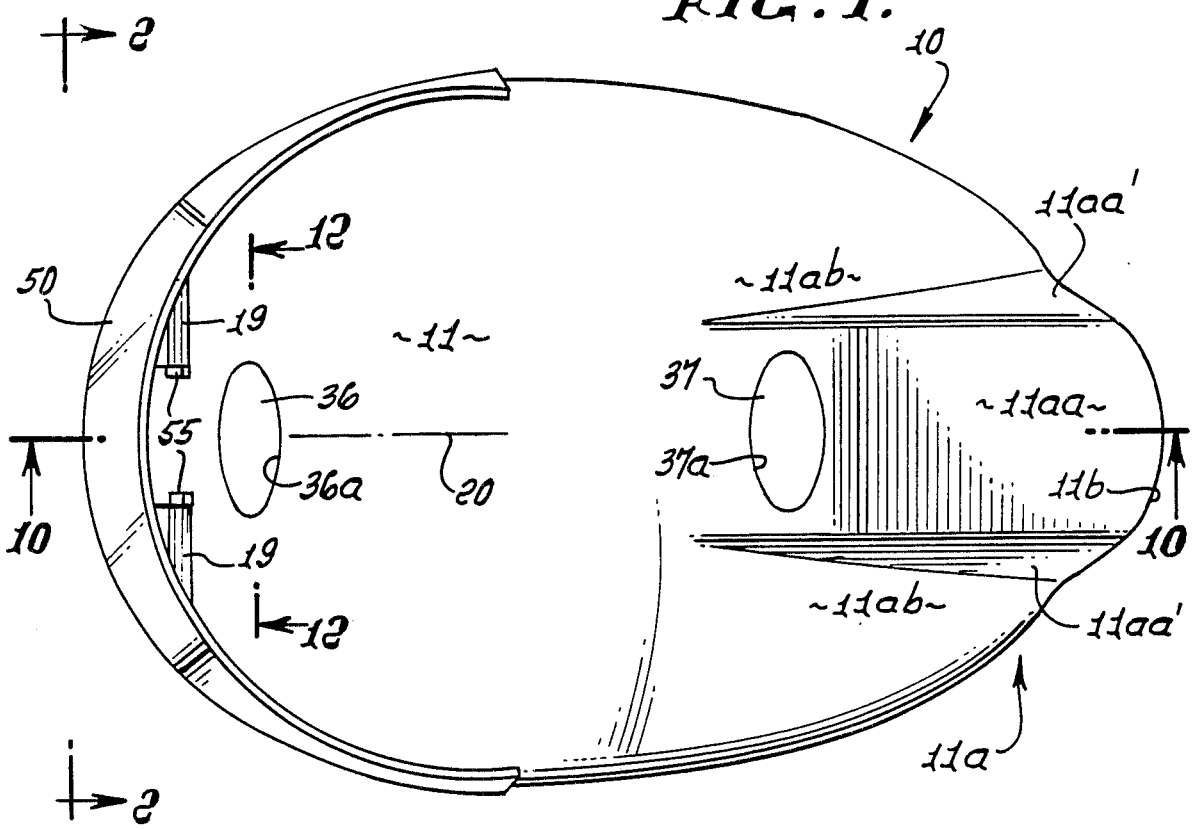
FIG. 1 is a top plan view of a helmet incorporating the invention.
Figure 2:
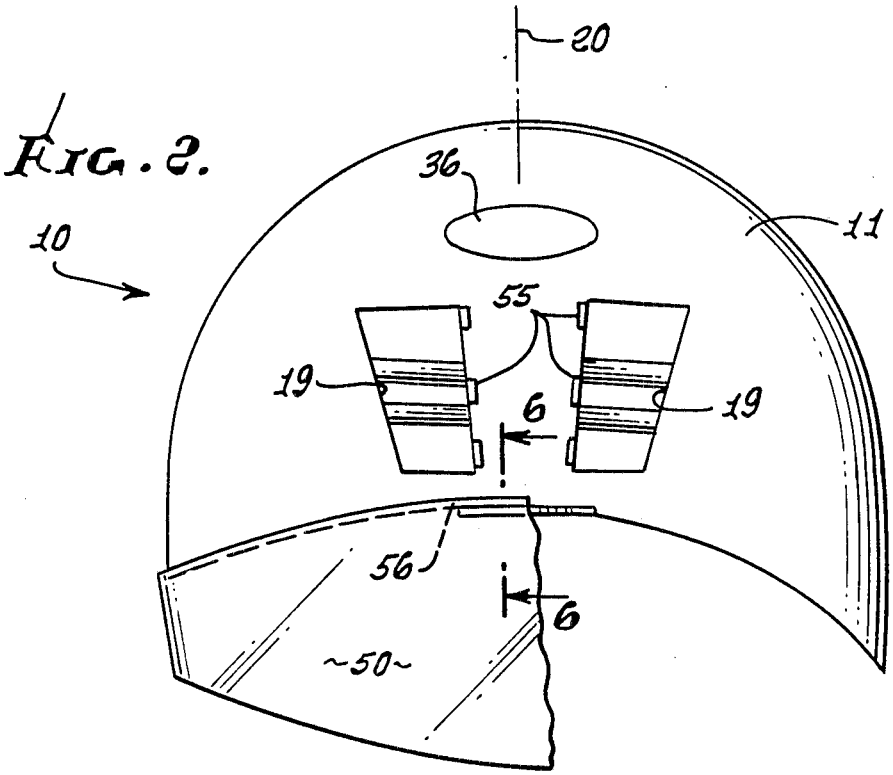
FIG. 2 is a front elevation on lines 2—2 of FIG. 1.

In the drawings, the helmet 10 includes an outer, relatively thin, dome shaped shell 11, and an inner relatively thicker liner 12. The shell consists for example of hard, molded plastic material such as DuPont ST 801 NYLON, or polycarbonate, and the liner consists for example of semi-flexible foam plastic material such as polystyrene or polyurethane.

As shown in FIGS. 1, 3, 10 and 11, the helmet is further characterized by the following features: it is forwardly and rearwardly elongated; the shell has rearwardmost upper extent 11*a* that is elevated relative to the liner rearward extent 12*a* to provide an air discharge or diffuser zone 13 to draw air smoothly from the helmet interior rearwardly through outlets 14 in the liner for discharge into the outer air stream flowing at 15 along the helmet rearwardly and downwardly slanted portion 11*aa*, to spill over edge 11*b* to aspirate air from zone 13; the helmet section 11*a* is upwardly humped at 11*aa* as shown in FIG. 1, with lateral sides 11*aa'* upstanding from the rearwardly elongated sufaces 11*ab*; and the helmet has lower side edges that extend downwardly and rearwardly at 16 toward lowermost midregions 17, and then extend upwardly and rearwardly at 18 with curvature as shown to terminate at rear edge 11*b*. Note exposed liner lower side extents 12*a*.

The helmet also has forward facing opening means defined for example by the two openings or inlets 19 located at left and right sides of a vertical central plane 20 that extends rearwardly. The front openings 19 include openings in both the shell and liner, the shell openings indicated at 19*a* and the liner openings at 19*b*, in FIG. 10. Entering air flows through those inlet openings and then into the helmet upper interior 21, and also into and rearwardly in channels 22 and 23 formed in the liner upwardly domed portion at opposite sides of central vertical plane 20. Channels 22 and 23 open into the helmet interior so that air in the latter is scavenged or circulated rearwardly toward outlets 14. The overall construction, as described, contributes to a ram air flow effect through the helmet, the inlets 19, channels 22 and 23, and outlets 14, as well as diffusing zone 13, contributing to the desired highly efficient air flow effect.

Figure 13:
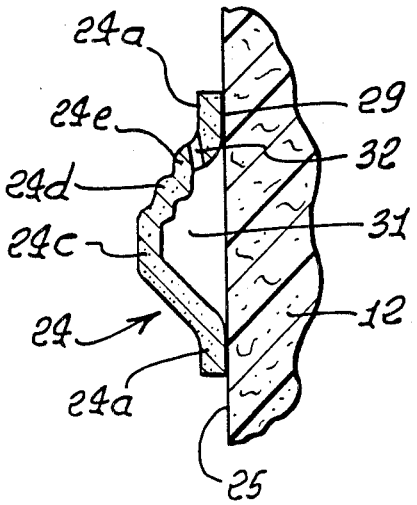
FIG. 13 is an enlarged section on lines 13—13 of FIG. 10.

Located in the helmet is padding carried by the liner to engage the wearer's head, the padding having bellows configurations, with sections that are successively collapsible upon engagement with a wearer's head. Such padding may, for example, include two pads 24 on each interior side wall 25 of of the liner, and two pads 26 on the rear interior wall 27 of the liner. Each pair of pads 24 is shown as integral with a flanged base sheet 24*a* attached to the liner wall, as by suitable adhesive 29. See FIG. 13. Each pad may consist of rather stiff foam rubber, or other synthetic material, and include multiple sections having corrugated or bellows configuration, as at 24*c, d* and *e*, in FIGS. 10 and 13, successive sections toward the liner being larger, i.e. of greater peripheral outline. Air space 31 in the pad interior receives inward resilient collapse of the sections, air escaping via vent 32. Thus, the pads quickly, readily and comfortably adjust to the head size of the helmet wearer. A perspiration absorbing pad 33 extends arcuately at the front of the helmet interior, and is bonded to liner wall 34, below the levels of inlets 19*b*. Additional top and side pads appear at 80 and 81.

Figure 3:
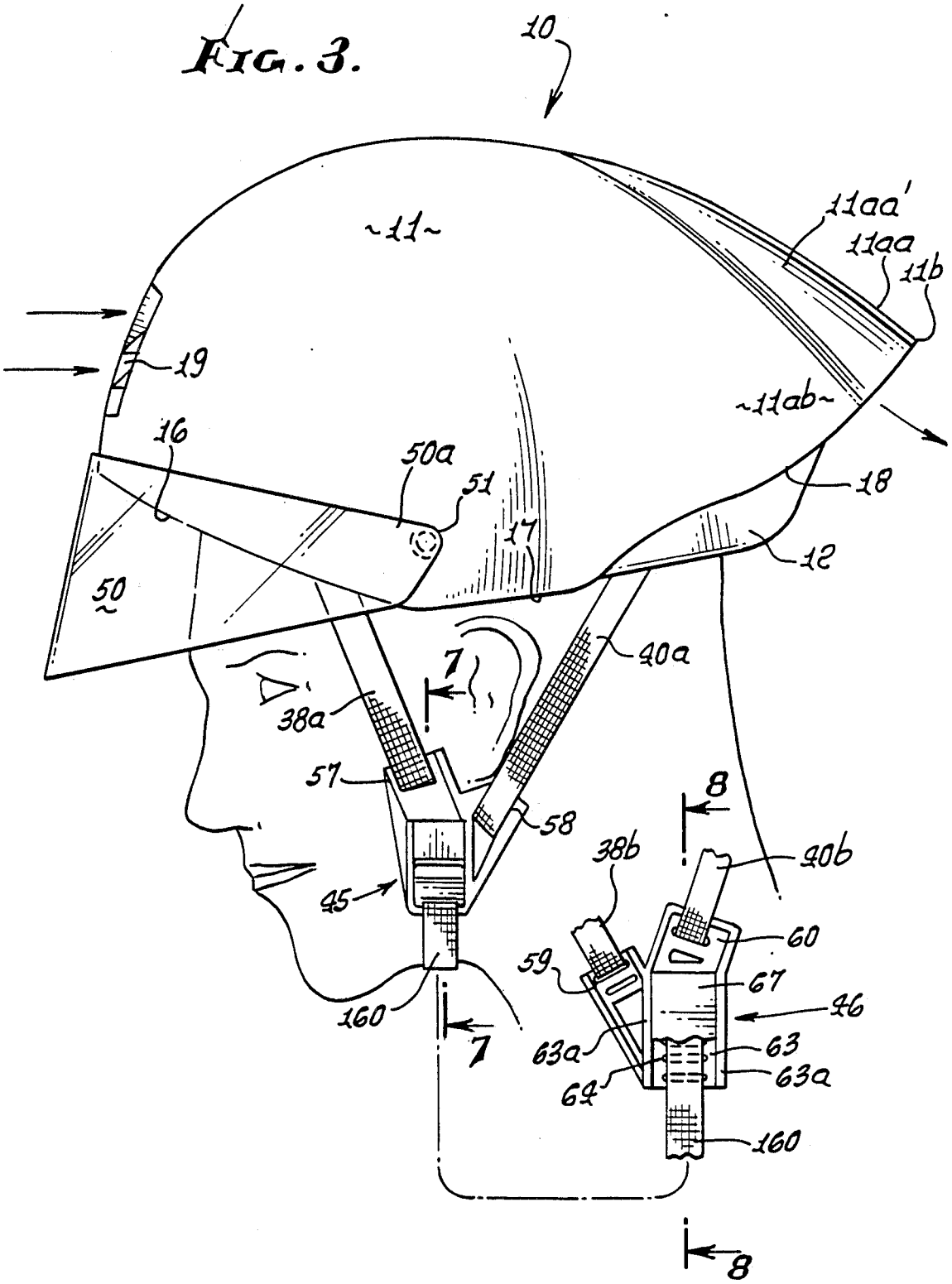
FIG. 3 is a left side elevational view of the FIG. 1 helmet.
Figure 12:
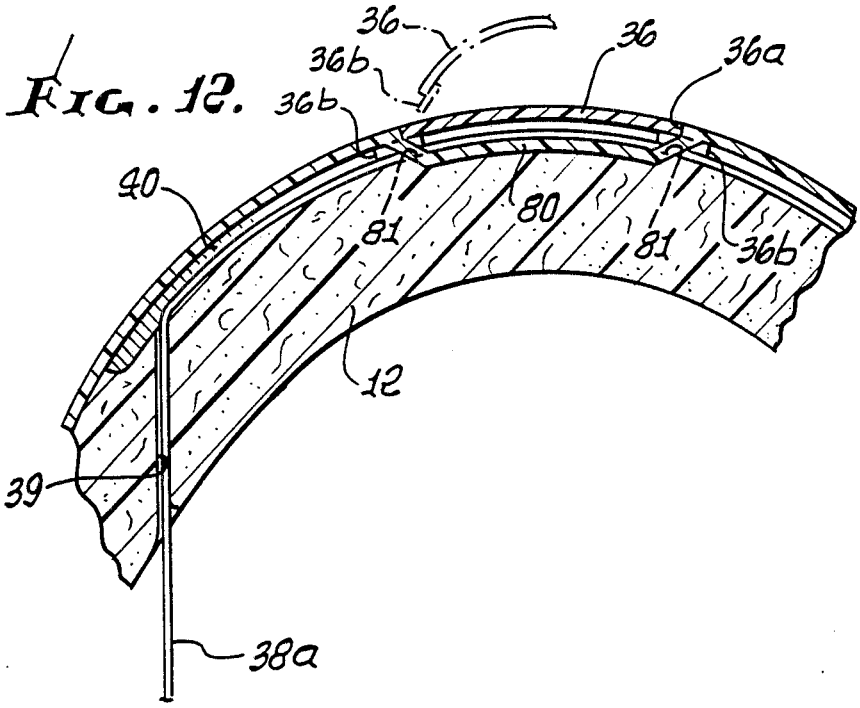
FIG. 12 is an enlarged section on lines 12—12 of FIG. 1.

Referring now to FIGS. 1, 3. 10, 11 and 12, the shell defines insert plug means, and the latter acts or act to cover attachments to the shell of retention straps that extends from the wearer's chin upwardly into the helmet and through slots formed in the liner of the vicinity of the plug means. In this regard, the plug means are advantageously located at or near the top of the shell; thus, forward and rearward such insert plugs 36 and 37 are received into openings 36*a* and 37*a* formed in the shell. Two downward hanging straps (i.e. left and right) are attached to inwardly offset shell section 80, as by passing over said section and through slots 81 in the shell. Thus forward left and right straps 38*a* and 38*b*, as seen in FIG. 3, extend upwardly through slots 39 cut in the liner (see FIG. 12), then wrap over the top of the liner in grooves 40, and then extend through slots 81 and over the shell offset section 80. Plug fits into opening 36*a* to close same and cover the section 80. Plug wings 36*b* fit under the edges of the opening 36*a* in the shell, and the plug is retained in position. The liner itself is bonded to the shell.

Rear left and right straps 40*a* and 40*b* attach to rear plug 37, in the same may as straps 38*a* and 38*b* connect to plug 36.

Figure 4:
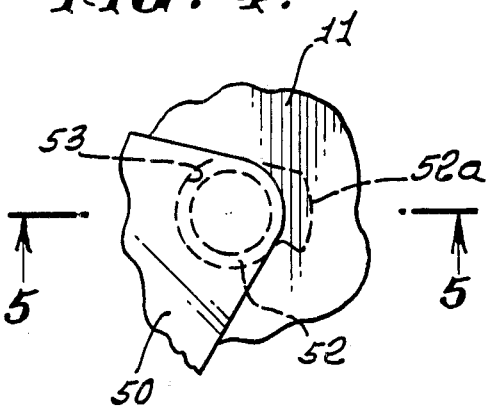
FIG. 4 is an enlarged fragmentary elevation showing connection of a visor pivot.
Figure 7:
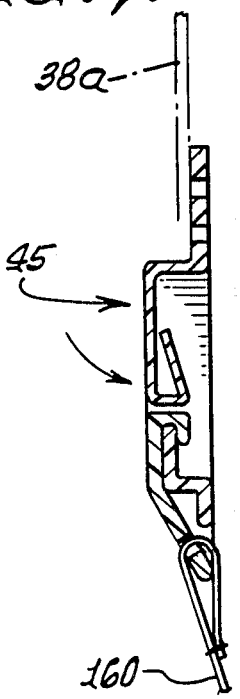
FIG. 7 is a section on lines 7—7 of FIG. 3 showing a left side strap clip.
Figure 5:
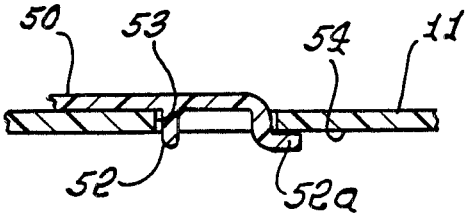
FIG. 5 is a section on lines 5—5 of FIG. 4.
Figure 6:
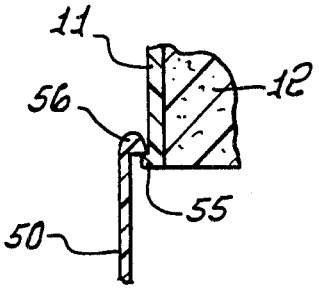
FIG. 6 is an enlarged fragmentary elevation on lines 6—6 of FIG. 2.
Figure 8:
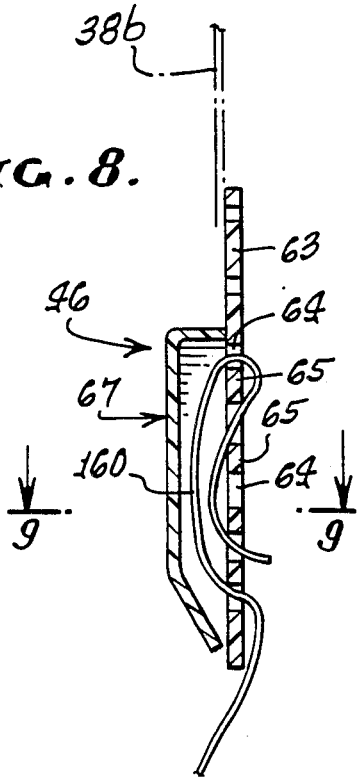
FIG. 8 is a section taken on lines 8—8 of a right side strap clip, also shown in association with FIG. 3.
Figure 9:
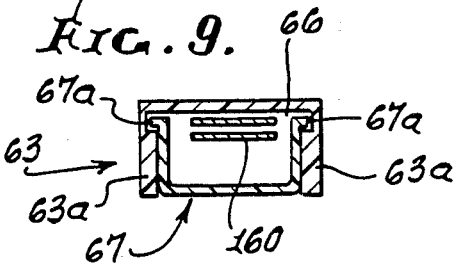
FIG. 9 is a section on lines 9—9 of FIG. 8.
Figure 10:
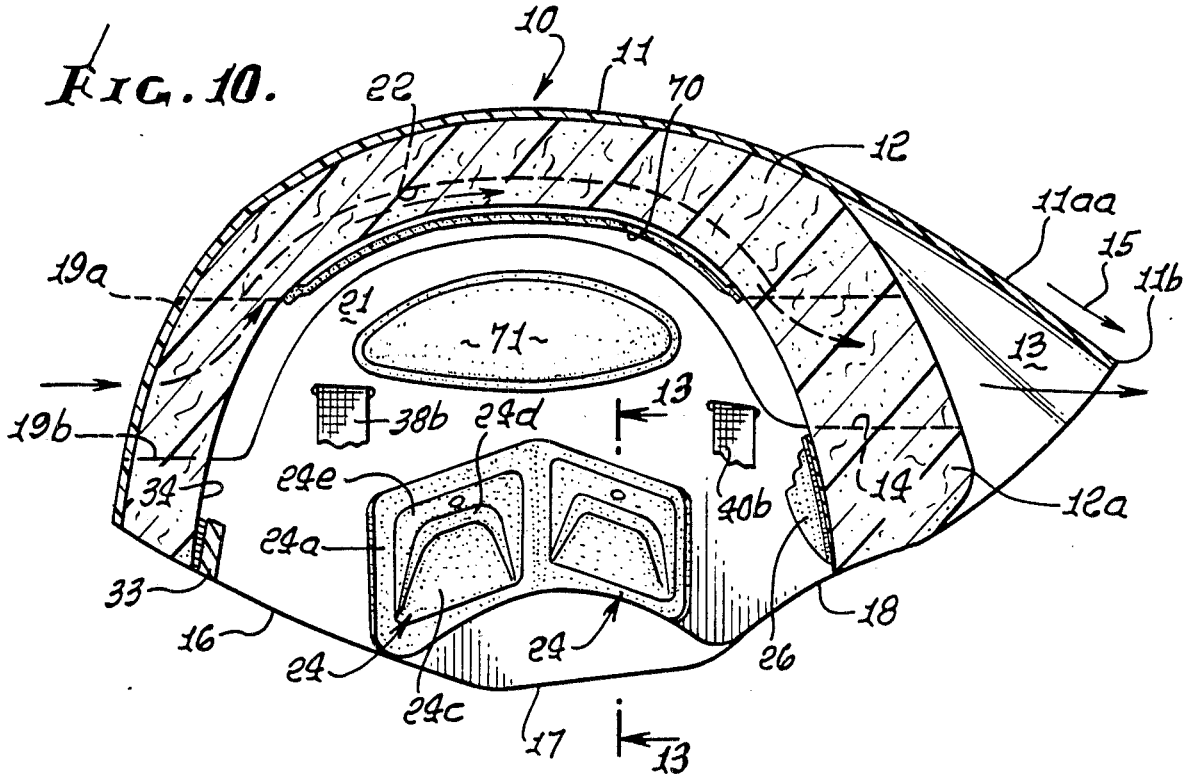
FIG. 10 is a section taken in elevation on lines 10—10 of FIG. 1.
Figure 11:
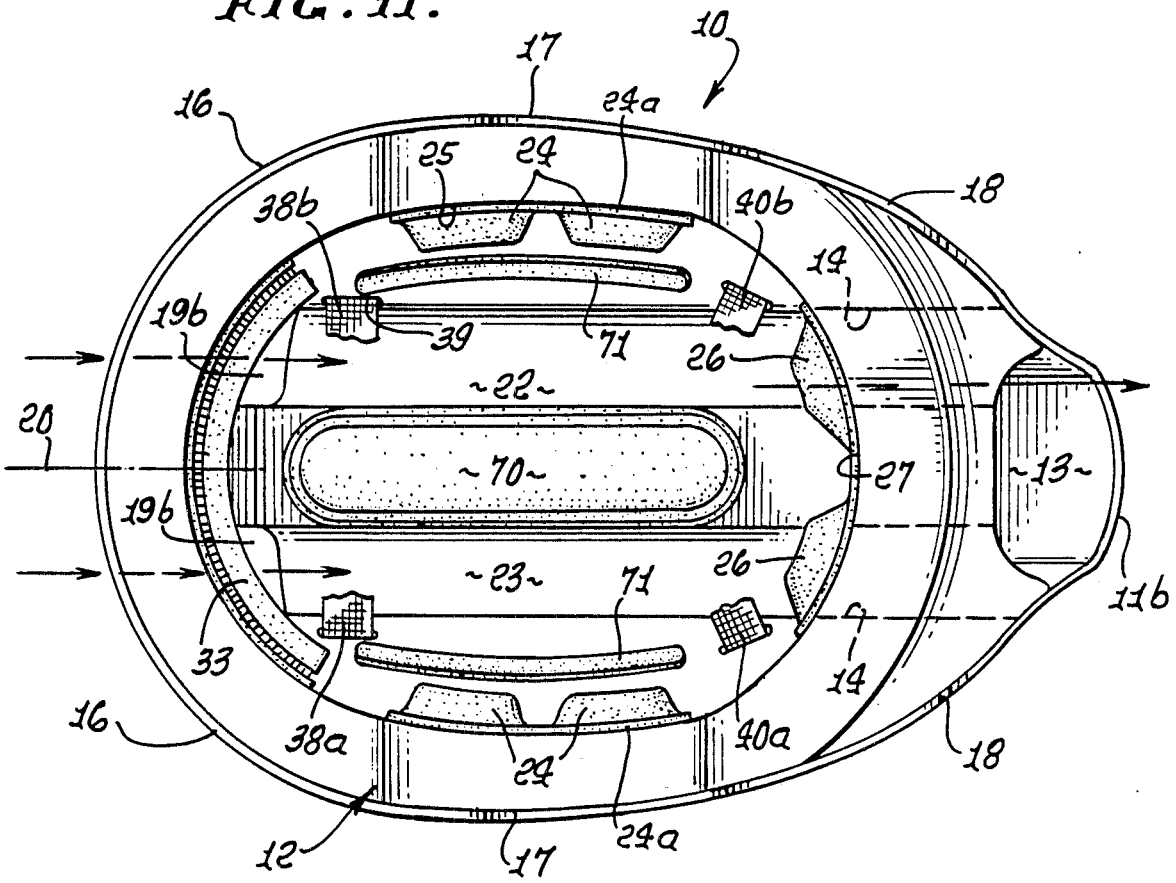
FIG. 11 is a bottom plan view of the FIG. 1 helmet.

The helmet has a thin, transparent, darkened plastic visor 50 that wraps closely about the entirety of the forward portion of the helmet, to closely conform to the contour thereof. The visor tapers rearwardly at opposite forward sides of the helmet, and has terminal rearward extents 50*a* pivotally attached to the helmet at 51. FIGS. 4 and 5 show the visor to have integral pivot stud 52, lockably received in corresponding pivot openings 53 in the sides of the shell. For this purpose, the circular stud 52 may have a lip portion 52*a* insertible through opening 53, and then projected beneath the inner side 54 of the shell (see FIG. 5), to retain the stud in opening 53, and to rotate in position.

To hold the visor in selected vertical positions, detents are provided at the exterior forward extent of the helmet, and engagable by the visor in different selected elevation positions of the visor. See for example detent ridges 55, proximate the openings 19, and successively engagable by the tab 56 on the visor upper edge, for retaining the visor in position. Each detent 55 may be recessed to receive and hold the tab 56, until the visor is forcibly elevated or lowered, removing the tab from the recess.

Finally, FIGS. 3, 7, 8 and 9 show the provision of a helmet retention system comprising left and right clips 55 and 56 respectively attached to the strap sections 38*a*, 40*a* and 38*b* and 40*b*. The clips are generally Y-shaped and straps 38*a* and 40*a* are attached at 57 and 58 to clip 55; and straps 38*b* and 40*b* are attached to clip 56 at 59 and 60. Clip 56 is shown shifted out of position, for clarity, in FIG. 3.

Chin strap 60 is attached at 61 to clip 56 includes at 62 to clip 56. More specifically, the clip 56 includes a buckle portion 63 defining a series of parallel slots 64 into which excess strap length may be manually woven, for retention. See FIG. 8, also showing parallel bars 65 between the slots, and around which excess strap may be woven, as shown. The buckle portion 63 has outstanding walls 63*a* defining a recess 66. A buckle cover 67 removably snaps into the recess (see retention tangs 67*a*), to cover the excess strap extent woven into the slots 64.

I claim:

1. In a forwardly extending protective helmet, the combination including (a) an outer shell containing forwardly facing opening means through which air streams may enter the helmet, (b) a liner in said outer shell and supporting same adjacent said openings, (c) the liner forming air flow channeling communicating with said opening means, the channeling openly facing the interior of the helmet lengthwise of said channeling for conducting air toward the rear of the helmet, (d) and the liner containing a rearwardly facing outlet below the shell and rearward of said channeling for discharging air therefrom, (e) said liner having an uppermost domed portion defining said channeling in the form of laterally spaced, forwardly and rearwardly elongated channels, (f) and including helmet retention straps extending through the liner and attached to the shell, inwardly of the outer surface thereof, and in spaced relation to said channeling, (g) the shell having a local portion inwardly offset toward the helmet interior relative to said shell outer surface, at least one strap extending over said portion, (h) and including plug means integral with the shell and covering said shell local portion and the strap extending thereover, 2. The helmet of claim 1 wherein there are two of said shell local portion that are inwardly offset, said plug means including forward and rearward plugs covering said two offset portions toward each of which two straps extend.

3. The combination of claim 1 including padding carried by said liner to engage the wearer's head, said padding having bellows configuration with sections that are successively resiliently collapsible upon engagement with a wearer's head.

4. The helmet of claim 3 wherein said padding includes pads attached to the inner side of said liner, there being collapsible air spaces between said pads and the liner.

5. The helmet of claim 4 wherein said pads are distributed about the inner side of the liner.

6. The helmet of claim 5 wherein pairs of said pads are located at lateral inner sides of the liner, and at the rear inner side of the liner, the pads of each pair being integral with a pad base attached to the liner.

7. The helmet of claim 3 wherein the pad sucessively collapsible sections are of successively greater peripheral outline, facing the helmet interior.

8. The helmet of claim 1 wherein said plug means has wing means clamped between the shell and liner.

9. In a forwardly extending protective helmet, the combination including (a) an outer shell containing forwardly facing opening means through which air streams may enter the helmet, (b) a liner is said outer shell and supporting same adjacent said openings, (c) the liner forming air flow channeling communicating with said opening means, the channeling openly facing the interior of the helmet lengthwise of said channeling of conducting air toward the rear of the helmet, (d) and the liner containing a rearwardly facing outlet below the shell and rearward of said channeling for discharging air therefrom, (e) said forward facing opening means being at the center front of the helmet, and said rearward outlet at the center rear of the helmet, the helmet being elongated rearwardly toward said center rear outlet, the forward facing opening means, said channeling and said rearward outlet being in such direct and unobstructed alignment as to provide a ram air flow effect through the helmet, and (f) the outer shell having rearward upper extent that is raised and extends rearwardly and divergently away from and relative to the liner to provide a discharge zone directly rearwardly of said liner outlet and below the shell rearward divergent extent for diffusing air flow toward a rearward edge defined by the outer shell and over which an exterior air stream flows, with aspirating effect.

10. The helmet of claim 9 wherein said liner has an uppermost domed portion defining said channeling in the form of laterally spaced, forwardly and rearwardly elongated channels.

11. The helmet of claim 9 including padding carried by said liner to engage the wearer's head, said padding having bellows configuration and being resiliently collapsible upon engagement with a wearer's head.

12. The helmet of claim 11 wherein said padding includes pads attached to the inner side of said liner, in spaced relation to said channeling, there being collapsible air spaces between successively collapsible portions of said pads and the liner.

13. The helmet of claim 9 including helmet retention straps extending through the liner and attached to the shell, inwardly of the outer surface thereof.

14. The combination of claim 9 including the shell defining insert plug means, and helmet retention strap means extending through slots in the liner and attached to said shell at locations covered by said plug means, the strap means also including a chin strap.

15. The helmet of claim 14 including a buckle attached to said strap means and defining a series of slots into which excess strap length may be manually woven, for retention.

16. The helmet of claim 15 including a buckle cover covering said slots, and received into a recess formed by the buckle.

17. The helmet of claim 9 including a transparent, darkened visor closely wrapping about the forward portion of the helmet to conform to the contour thereof, the visor having rearward terminal extents pivotally attached to the helmet, and there being detent means at the exterior forward extent of the helmet engageable by the visor in different elevation positions thereof.

18. The helmet of claim 17 wherein the visor has integral pivot studs projecting from said rearward terminal extents of the visor and lockably received in corresponding pivot openings in the sides of the shell.

* * * * *